US006550731B1

(12) United States Patent
Kim

(10) Patent No.: US 6,550,731 B1
(45) Date of Patent: Apr. 22, 2003

(54) DEVICE FOR MOUNTING SIGN OF DIRECTION TO POST

(76) Inventor: Yong Soo Kim, Hanyang Apt. #310-902, No. 732, Madoo-dong, Ilsan-gu, Koyang-city, Kyungki-do (KR)

( * ) Notice: Subject to any disclaimer, the term of this patent is extended or adjusted under 35 U.S.C. 154(b) by 0 days.

(21) Appl. No.: 09/150,176

(22) Filed: Sep. 9, 1998

(30) Foreign Application Priority Data

Sep. 9, 1997 (KR) ..... 97-46342

(51) Int. Cl.[7] ..... A47B 96/00
(52) U.S. Cl. ..... 248/223.41; 40/607; 40/612
(58) Field of Search ..... 248/224.61, 224.51, 248/223.41, 218.4; 40/606, 607, 612

(56) References Cited

U.S. PATENT DOCUMENTS 4,021,973 A * 5/1977 Hegg et al. ..... 248/223.41 X
4,040,194 A * 8/1977 Penton et al. ..... 40/607 X
4,163,537 A * 8/1979 Mourgue ..... 248/223.41 X
4,458,455 A * 7/1984 Tollstoff de Voss ..... 52/38

* cited by examiner

*Primary Examiner*—Ramon O. Ramirez
(74) *Attorney, Agent, or Firm*—Jacobson Holman PLLC

(57) ABSTRACT

A device capable of firmly mounting a sign of direction to a post is disclosed. A cylindrical connector is fitted into the top end of the post, while an annular locking member is fitted over the connector. The locking member has a plurality of longitudinal locking grooves on its external surface at regularly spaced positions. The locking grooves individually have a T-shaped cross-section. A sign holder is slidably and detachably locked to the locking grooves of the locking member and is used for holding the sign on the post. The sign holder is provided with both a slide insert part and a sign holding part, thus being locked to the locking member at the insert part and holding the sign at the sign holding part. A plurality of longitudinal locking grooves may be directly formed on the external surface of the post in place of a separate locking member.

3 Claims, 4 Drawing Sheets

– PRIOR ART –

DEVICE FOR MOUNTING SIGN OF DIRECTION TO POST

BACKGROUND OF THE INVENTION

1. Field of the Invention

The present invention relates, in general, to a device for mounting a thin panel such as a sign of direction to a post and, more particularly, to a device for mounting such a thin panel to a post while allowing a direction of the thin panel on the post to be easily adjustable without allowing the panel to unexpectedly move in the wind.

2. Description of the Prior Art

FIG. 1 is an exploded perspective view showing the construction of a typical device for mounting a sign of direction to a post. As shown in the drawing, the typical device comprises a tightening band 12 which is to be fitted over a post 10 at a desired position. The tightening band 12 has two flanges 14 at its both ends with a gap 16 being defined between the two flanges 14. A sign 30 of direction is inserted into the gap 16 of the two flanges 14. Thereafter, the sign 30 is fixed to the tightening band 12 by bolting the sign 30 to the holes 15 of the flanges 14 using locking means such as bolts 17*a* and nuts 17*b*.

However, the above device is problematic in that it is somewhat difficult for a worker to precisely set the length of the tightening band 12 while mounting a sign 30 of direction to a post 10 using such a band 12. This reduces work efficiency while mounting signs of direction to posts. In addition, the tightening band 12 on the post 10 may be easily loosened and this allows a sign 30 of direction to rotate in the wind. In such a case, the sign 30 fails to perform its function.

SUMMARY OF THE INVENTION

Accordingly, the present invention has been made keeping in mind the above problems occurring in the prior art, and an object of the present invention is to provide a device capable of firmly mounting a sign of direction to a post.

Another object of the present invention is to provide a device capable of stably mounting a sign of direction to a post without allowing the sign to unexpectedly move on the post in the wind.

A further object of the present invention is to provide a device capable of mounting a plurality of signs of direction to one post when necessary.

In order to accomplish the above object, an embodiment of the present invention provides a device for mounting a sign to a post, comprising: a cylindrical connector fitted into the top end of the post, the connector being exteriorly stepped at its middle portion, thus having a small-diameter part and a large-diameter part at its upper and lower parts, respectively; an annular locking member fitted over the small-diameter part of the connector, the locking member having a plurality of longitudinal locking grooves on its external surface at regularly spaced positions, the locking grooves individually having a T-shaped cross-section; and a sign holder slidably and detachably locked to the locking grooves of the locking member and used for holding the sign on the post, the sign holder being provided with both a slide insert part and a sign holding part, so that the sign holder is locked to the locking member at the insert part while holding the sign at the sign holding part, with the insert part having the same cross-section as that of each of the locking grooves and the sign holding part being slitted to receive the sign and being holed to fix the sign.

In accordance with another embodiment of the present invention, a plurality of longitudinal locking grooves may be directly formed on the external surface of the post at regularly spaced positions.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
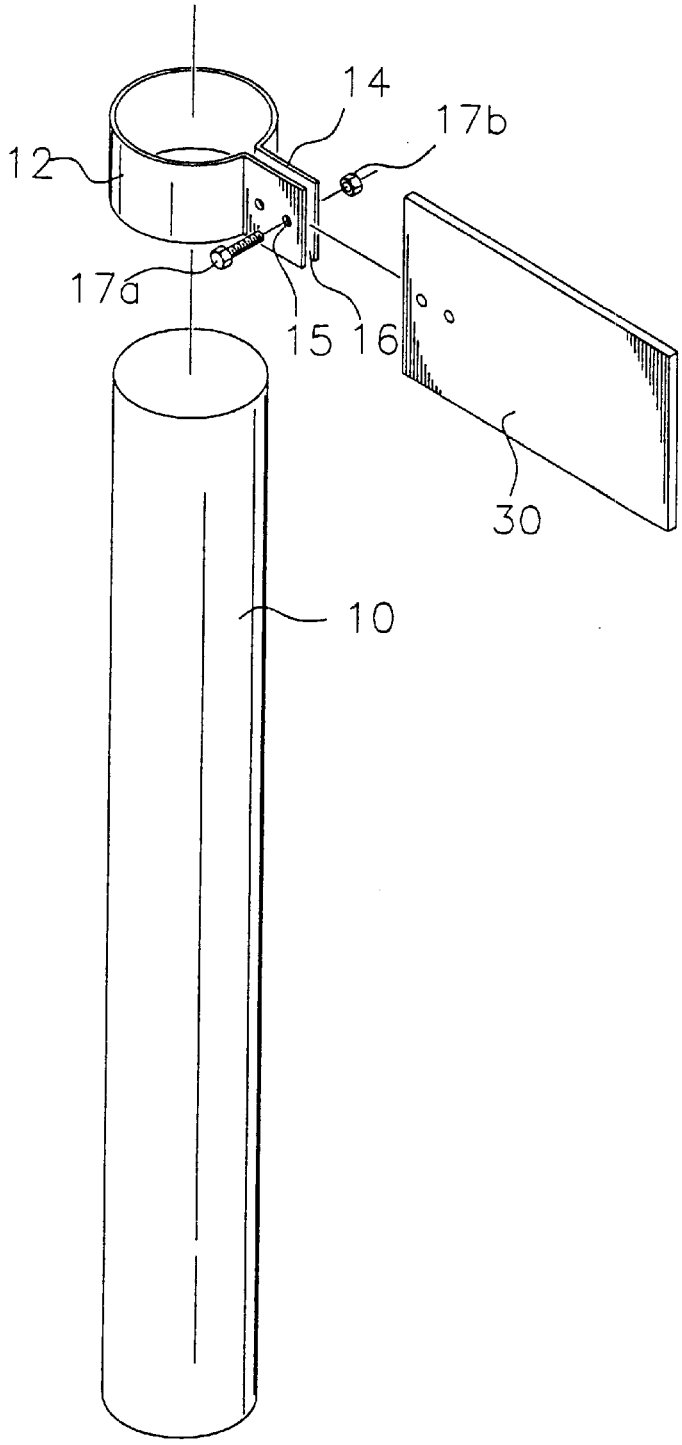
FIG. 1 is an exploded perspective view showing the construction of a typical device for mounting a sign of direction to a post.
Figure 2:
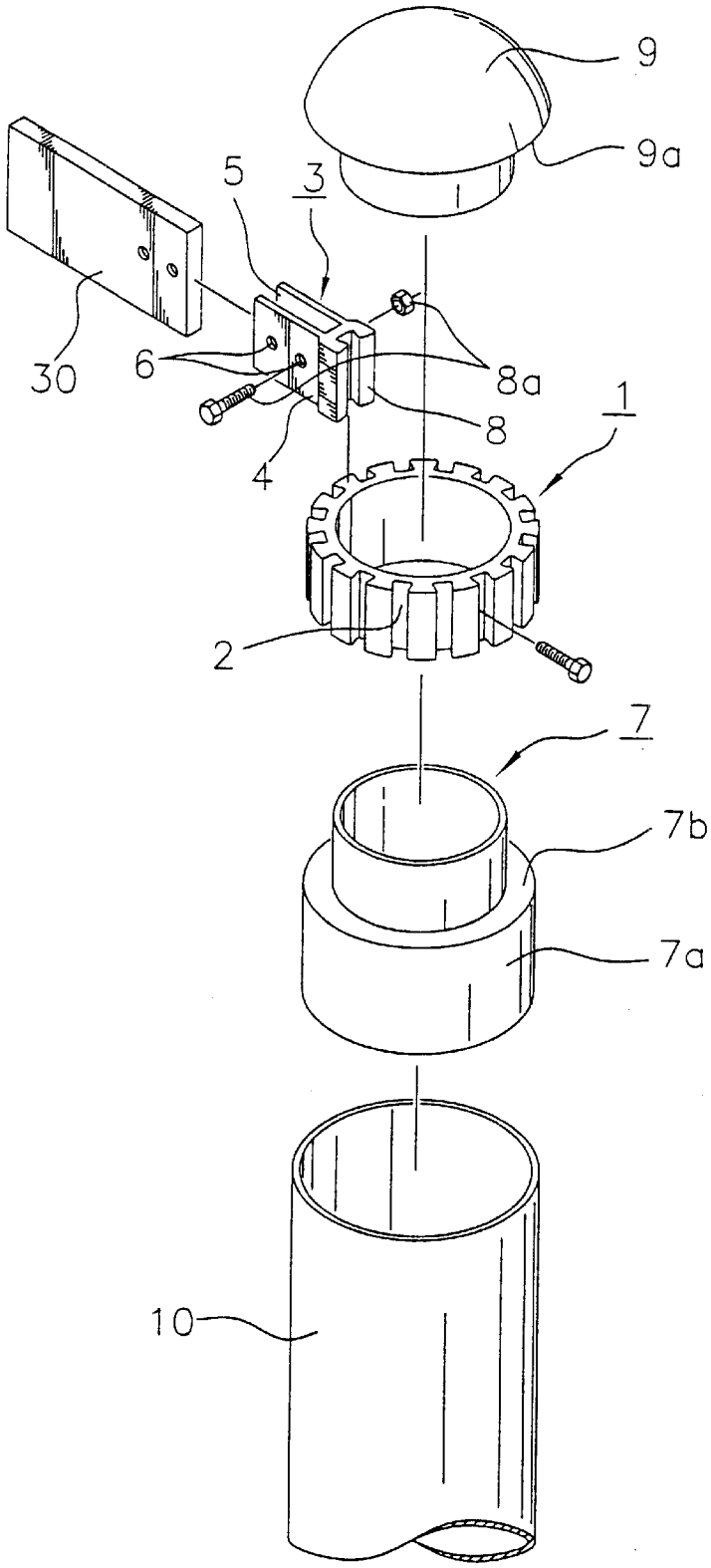
FIG. 2 is an exploded perspective view showing the construction of a device for mounting a sign of direction to a post in accordance with the primary embodiment of the present invention.
Figure 3:
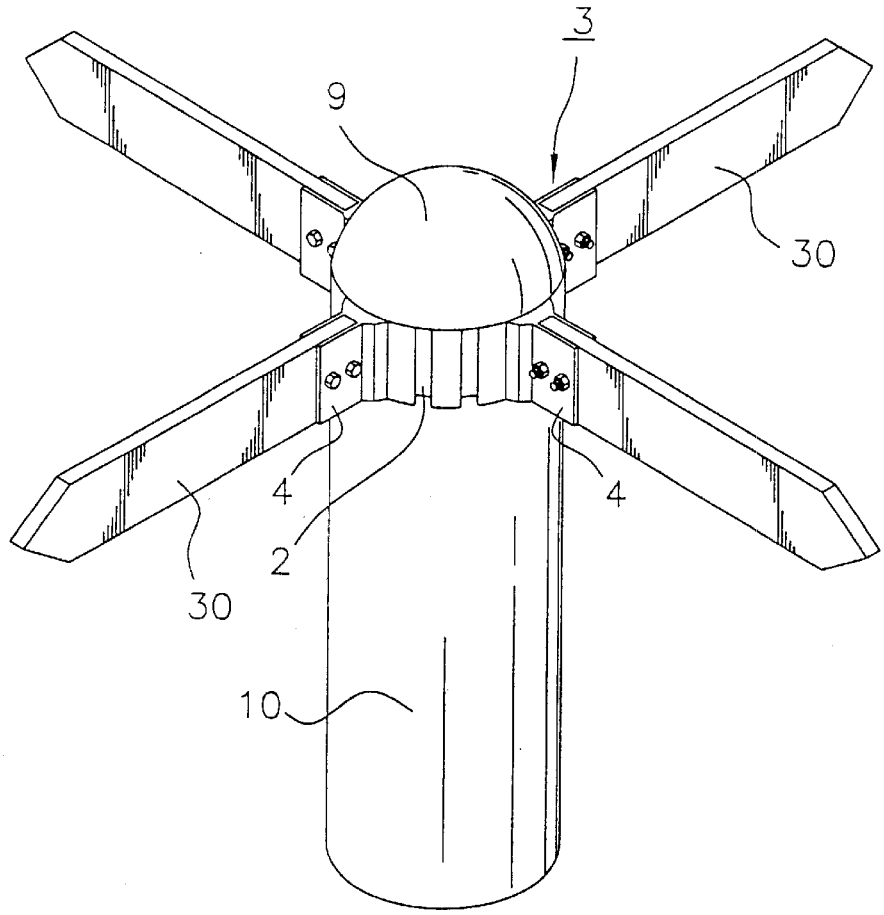
FIG. 3 is a perspective view showing a plurality of signs of direction commonly mounted on one post using the sign mounting device of FIG. 2.
Figure 4:
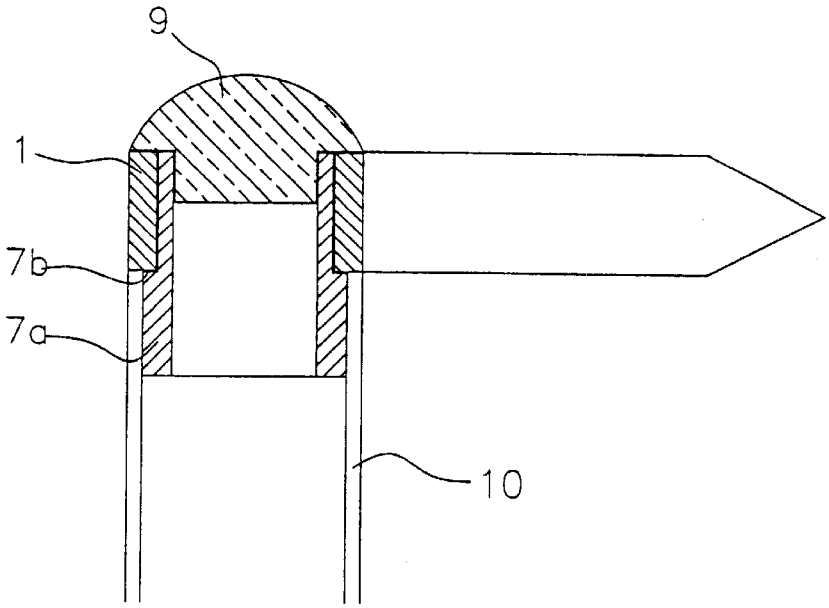
FIG. 4 is a sectional view of the sign mounting device of FIG. 2 with the parts of the device being assembled with each other to mount a sign to a post.

FIGS. 2 to 4 show the construction of a device for mounting a sign of direction to a post in accordance with the primary embodiment of this invention.

As shown in the drawings, the device of this invention comprises an annular locking member 1, a sign holder 3 and a cylindrical connector 7. The above connector 7, fitted into the top end of a post 10, is exteriorly stepped at its middle portion 7*b*, thus having a small-diameter part and a large-diameter part 7*a* at its upper and lower parts, respectively. The annular locking member 1 is fitted over the small-diameter part of the connector 7. The locking member 1 has a plurality of longitudinal locking grooves 2 on its external surface at regularly spaced positions. The locking grooves 2 individually have a T-shaped cross-section. The sign holder 3 is slidably and detachably locked to the locking grooves 2 of the locking member 1 and is used for holding a sign 30 on the post 10. The sign holder 3 is provided with both a slide insert part 8 and a sign holding part 4, so that the sign holder 3 is locked to the locking member 1 at the insert part 8 while holding the sign 30 at the sign holding part 4. The insert part 8 has the same cross-section as that of each of the locking grooves 2, while the sign holding part 4 has both a slit 5 for receiving the sign 30 and a plurality of holes 6 for fixing the sign 30.

In order to mount a sign 30 to a post 10 using the device of this invention, the post 10 is primarily and vertically supported on the ground. Thereafter, the locking member 1 is installed on the post 10 at a desired height. In such a case, the cylindrical connector 7 is fitted into the top end of the post 10 prior to fitting the annular locking member 1 over the small-diameter part of the connector 7. The locking member 1 is stopped by the stepped middle portion 7*b* of the connector 7.

Thereafter, the sign holder 3 engages with a selected one of the locking grooves 2 of the locking member 1 by fitting the insert part 8 of the sign holder 3 into the selected locking groove 2. In such a case, the insert part 8 of the sign holder 3 is closely fitted in the locking groove 2 of the locking member 1, so that the sign holder 3 is almost completely prevented from being unexpectedly removed from the locking member 1. When the sign holder 3 is fitted into the locking groove 2, the sign holder 3 is stopped by the stepped connector 7. Thereafter, the sign 30 is fitted into the slit 5 of the sign holding part 4 of the sign holder 3 prior to fixing the sign 30 to the holding part 4 using nuts and bolts 8*a*. A cap 9, having a plug part 9*a*, is, thereafter, fitted into the top end of the annular locking member 1 at the plug part 9*a*. The above cap 9 maintains the positions of the connector 7, the locking member 1 and the sign holder 3 on the post 10.

The sign 30 is thus firmly mounted to the post 10 while maintaining its direction even when it is exposed to strong wind. In accordance with the device of this invention, it is possible to mount one or more sign 30 to one post 10 since the annular locking member 1 has a plurality of locking grooves 2 which are formed at regularly spaced positions on the external surface of the locking member 1. FIG. 3 shown four signs 30 commonly mounted to one post 10. In such a case, the process for mounting the four signs 30 to the post 10 remains the same as that described above and further explanation is thus not deemed necessary. In addition, the slide insert part 8 of the sign holder 3 may be designed for being fitted into two or more looking grooves 2 of the locking member 1 at the same time.

Figure 5:
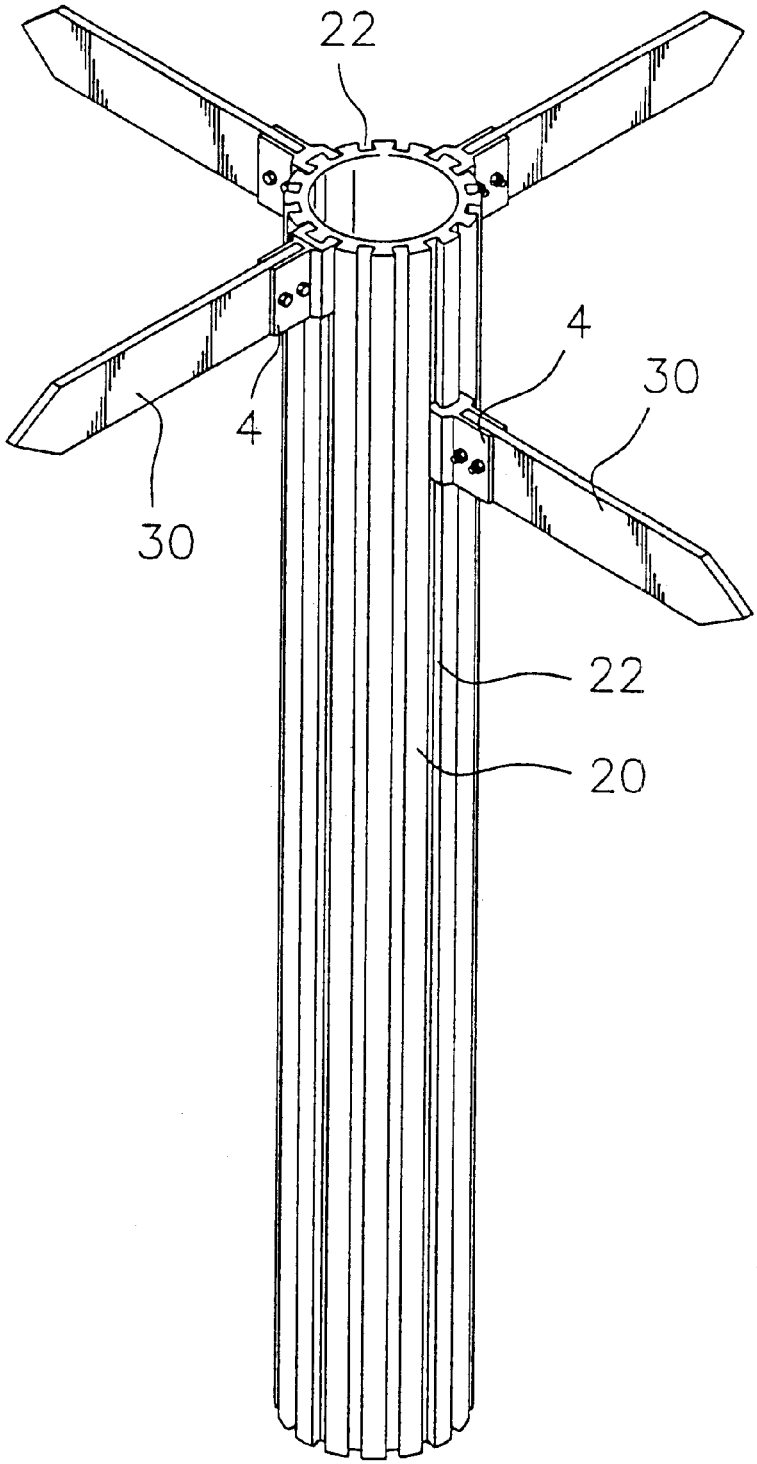
FIG. 5 is a perspective view showing a plurality of signs of direction commonly mounted on one post using a sign mounting device in accordance with another embodiment of the present invention.

FIG. 5 is a perspective view showing a plurality of signs 30 of direction commonly counted on one post 20 using a sign mounting device in accordance with another embodiment of the present invention. In this embodiment, a plurality of longitudinal locking grooves 22 are directly formed on the external surface of the post 20 at regularly spaced positions in place of a separate looking member 1 different from the primary embodiment. Both the cross-section of the locking grooves 22 and the construction of the sign holder remain the same as those described for the primary embodiment and further explanation is thus not deemed necessary. A stopper (not shown) is provided at a position under the sign holder, thus stopping the sign holder at a desired position in the locking grooves. The above stopper thus prevents the sign holder from moving down along the locking grooves.

As described above, the present invention provides a device capable of firmly mounting a sign of direction to a post. The above device also stably mounts the sign of direction to the post without allowing the sign to unexpectedly move on the post in the wind. Another advantage of the device resides in that it mounts a plurality of signs of direction to one post when necessary.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for mounting a sign to a post, comprising:

a cylindrical connector mounted on the post, said connector being exteriorly stepped at its middle portion, thus having a small-diameter part and a large-diameter part at its upper and lower parts, respectively;

an annular locking member fitted over said small-diameter part of the connector, said locking member having a plurality of longitudinal locking grooves on its external surface at regularly spaced positions, said locking grooves individually having a T-shaped cross-section; and a sign holder slidably and detachably locked to said locking grooves of the locking member and used for holding the sign on the post, said sign holder being provided with both a slide insert part and a sign holding part, so that the sign holder is locked to the locking member at the insert part while holding the sign at the sign holding part, with said insert part having the same cross-section as that of each of said locking grooves and said sign holding part being slitted to receive the sign and being holed to fix the sign.

2. The device according to claim 1, wherein a cap is assembled with a top end of said locking member, thus maintaining positions of the connector, the locking member and the sign holder on the post.

3. The device according to claim 1, wherein the number of slider insert part of said sign holder is one or more.

* * * * *